US005273326A

United States Patent [19]

Kinkaide

[11] Patent Number: 5,273,326

[45] Date of Patent: Dec. 28, 1993

[54] CARGO DOOR HOLD BACK

[75] Inventor: James R. Kinkaide, Elkhart, Ind.

[73] Assignee: Wells Cargo Inc., Elkhart, Ind.

[21] Appl. No.: 744,936

[22] Filed: Aug. 14, 1991

[51] Int. Cl.[5] ..... E05C 17/12

[52] U.S. Cl. ..... 292/272; 292/DIG. 38

[58] Field of Search ..... 292/262, 272, 273, 274, 292/DIG. 38, DIG. 19, DIG. 50, DIG. 43, DIG. 29, 265, 268, 213

[56] References Cited

U.S. PATENT DOCUMENTS

| | | | |
|---|---|---|---|
| 587,988 | 8/1897 | Morgan | 292/201 |
| 1,077,487 | 11/1913 | Miller | 292/213 |
| 1,490,575 | 4/1924 | Masury et al. | 292/80 |
| 1,799,265 | 4/1931 | Unkelbach et al. | 292/272 |
| 3,174,787 | 3/1965 | Kolman | 292/288 |
| 3,675,959 | 7/1972 | Hansen et al. | 292/DIG. 38 X |

*Primary Examiner*—Richard E. Moore
*Attorney, Agent, or Firm*—William D. Stokes

[57] ABSTRACT

A door hold back for holding the cargo door of a vehicle in the open positon while the vehicle is being loaded and unloaded wherein a link having spherical end portions is connectable between a socket provided in a mounting plate on the vehicle wall and a socket provided in a receiver on the cargo door. The spherical end portion on one end of the link in the base plate socket is larger than the spherical end portion on the other end of the link in the receiver socket so that the larger spherical end portion of the link is captivated in the base plate socket, and the smaller spherical end portion is releasably mounted in the receiver socket. The link and associated spherical end portions, mounting plate and receiver are all molded of high impact polypropylene plastic.

8 Claims, 2 Drawing Sheets

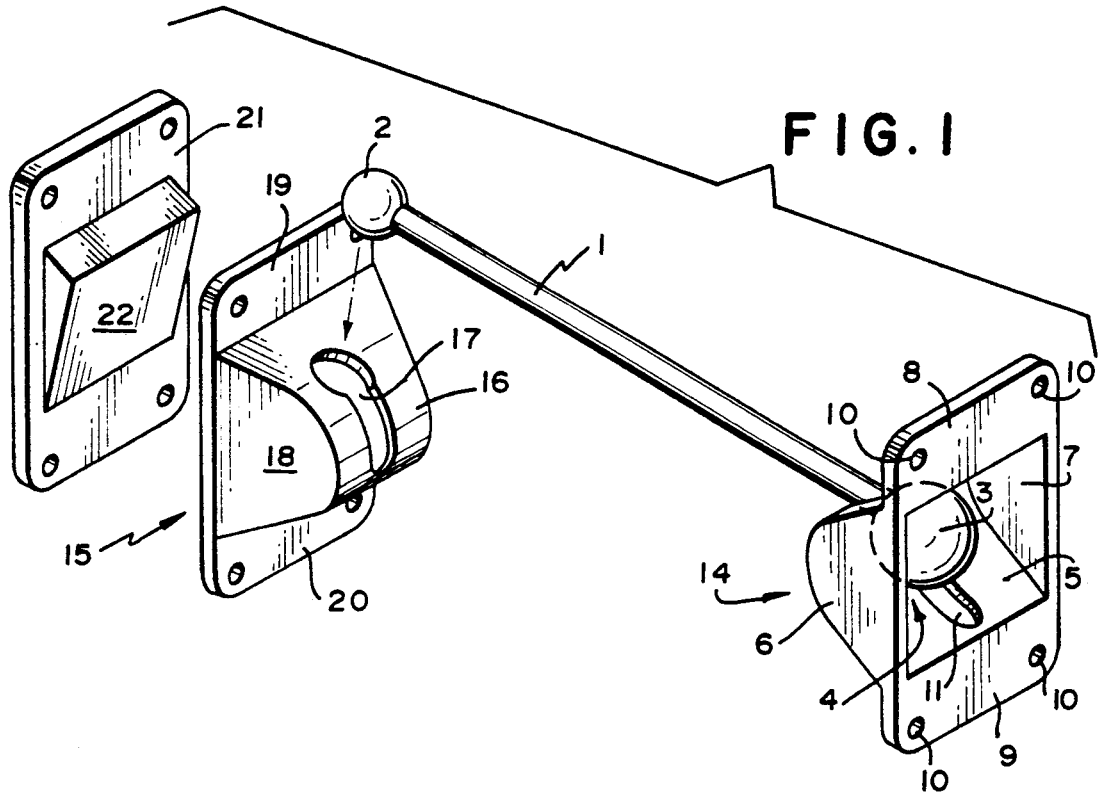
FIG. 1
FIG. 2
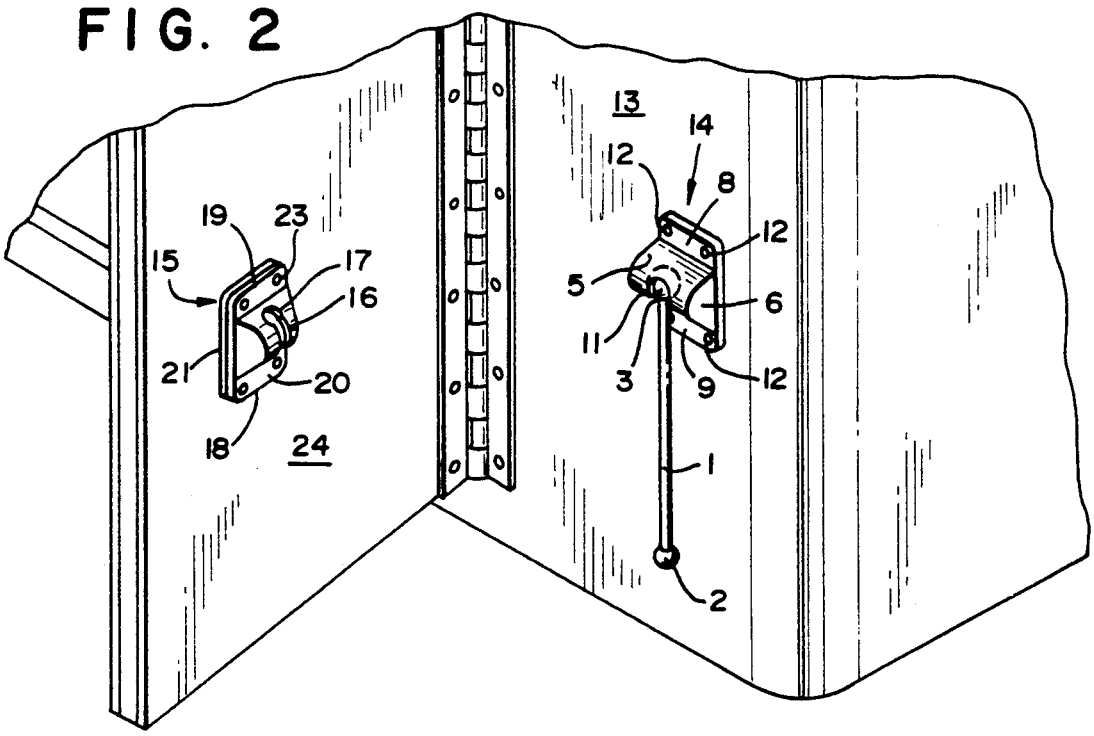

CARGO DOOR HOLD BACK

BACKGROUND OF THE INVENTION

Various hold backs have been proposed for holding doors of trucks or trailers in the open position while loading or unloading the vehicle.

These hold backs have consisted, essentially, of a metal link having a base fastened to the vehicle body and a hook portion insertable into a receiver secured to the vehicle cargo door.

While these hold backs have been generally satisfactory for their intended purpose, they have been subject to certain problems or disadvantages; such as, becoming rusty, therefore making it difficult to connect and disconnect the door, and both the base of the link and the receiver have to be aligned and mounted in the same vertical and horizontal planes so that the hook portion can be inserted into the receiver.

SUMMARY OF THE INVENTION

To overcome the disadvantages experienced with the prior art hold backs, the cargo door hold back of the present invention has been devised which comprises, essentially, a link having a spherical portion integral with each end thereof and wherein the spherical portion on one end of the link is mounted in a base plate secured to the exterior surface of a truck or trailer, and the spherical portion on the opposite end of the link is removably connected to a receiver secured to the exterior surface of the vehicle door.

The base plate and receiver are of similar construction and include an arcuate wall having a key hole slot formed therein, the arcuate wall terminating at each end thereof with an apertured flange for securing the base plate and receiver to their respective supporting surfaces.

By this construction and arrangement, the arcuate walls and respective supporting surfaces provide housings or sockets for receiving the respective spherical end portions of the link. The spherical end portion on the end of the link received within the base plate is larger than the spherical end portion on the opposite end of the link, whereby the end of the link connected to the base plate remains within its housing, while the opposite end of the link is removably mounted in the receiver.

The components of the hold back assembly are all of molded high impact polypropylene plastic to overcome the problems of rust, and the ball and socket connections on each end of the link allow for a misalignment of the base plate and receiver to thereby overcome the problem of aligning the base plate and receiver required in the prior art hold back devices.

Other advantages will become apparent to those skilled in the art as the description of the instant invention continues.

BRIEF DESCRIPTION OF THE DRAWINGS

FIG. 1 is an exploded, perspective view showing the components of the cargo door hold back of the present invention;

FIG. 2 is a fragmentary, perspective view of the door hold back mounted on the door and adjacent wall of a cargo carrying vehicle;

DESCRIPTION OF THE PREFERRED EMBODIMENT

Figure 3:
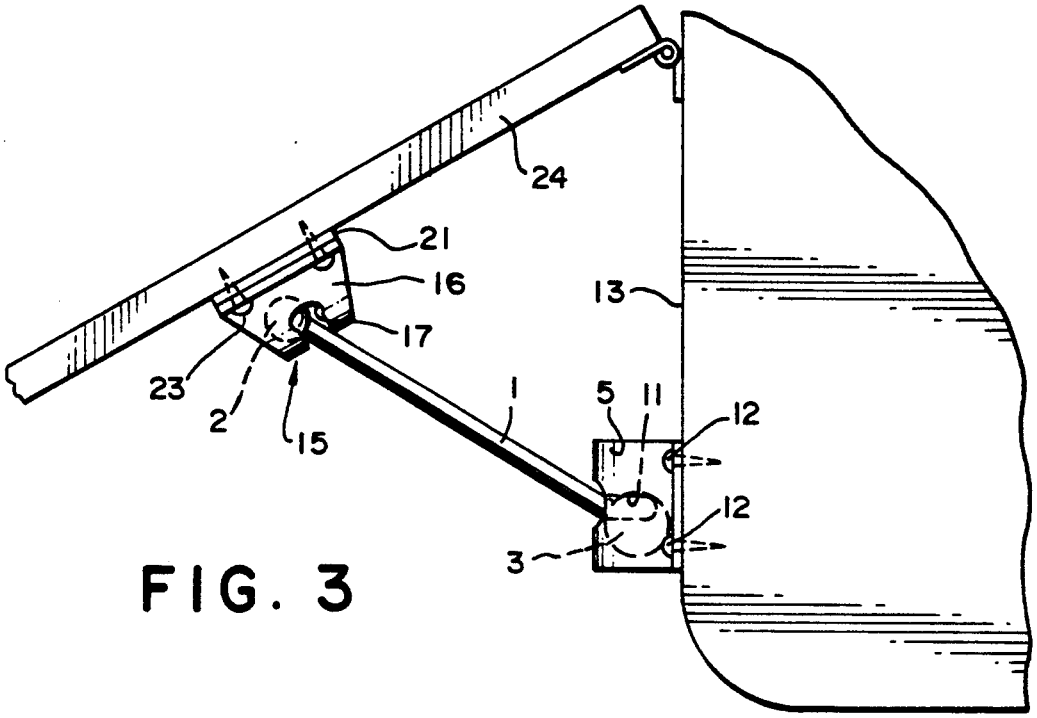
FIG. 3 is a fragmentary, top plan view of the door hold back in the operative position holding the door of FIG. 2 in the open position.

Referring to the drawings and more particularly to FIG. 1, the cargo door hold back of the present invention comprises a link 1 having spherical portions 2 and 3 integral with each end thereof. The spherical portion 3 is larger than spherical portion 2 and is adapted to be contained within a socket 4 formed by an arcuate wall 5 having side walls 6 and 7 and mounting flanges 8 and 9 provided with apertures 10. While the spherical portion 3 is contained within the socket 4, the link 1 extends through a key hole slot 11 provided in the arcuate wall 5.

As will be seen in FIG. 2, the apertured flanges 8 and 9 are adapted to receive suitable fasteners 12 for securing the socket 4 to the exterior wall surface 13 of a cargo carrying vehicle, whereby the arcuate wall 5, side walls 6 and 7, and flanges 8 and 9 form a base plate 14 for securing the spherical end portion 3 of the link to the vehicle.

The opposite spherical end portion 2 of the link 1 is similarly provided with a receiver 15 formed by an arcuate wall 16, having a key hole slot 17, side walls 18 and apertured flanges 19 and 20. A back-up plate 21 having an inclined surface 22 is also provided to enclose the receiver socket when mounted by suitable fasteners 23 on the outer surface of the vehicle cargo door 24 as shown in FIG. 2.

To secure the door hold back to the vehicle, the end of the link 1 having the smaller spherical portion 2 is inserted into the socket 4 of the base plate and through the arcuate key hole slot 11 until the spherical portion 3 abuts the portion of the arcuate wall 5 surrounding the key hole slot 11. The base plate assembly 14 and associated link 1 are then secured to the vehicle wall 13 by fasteners 12.

Figure 4:
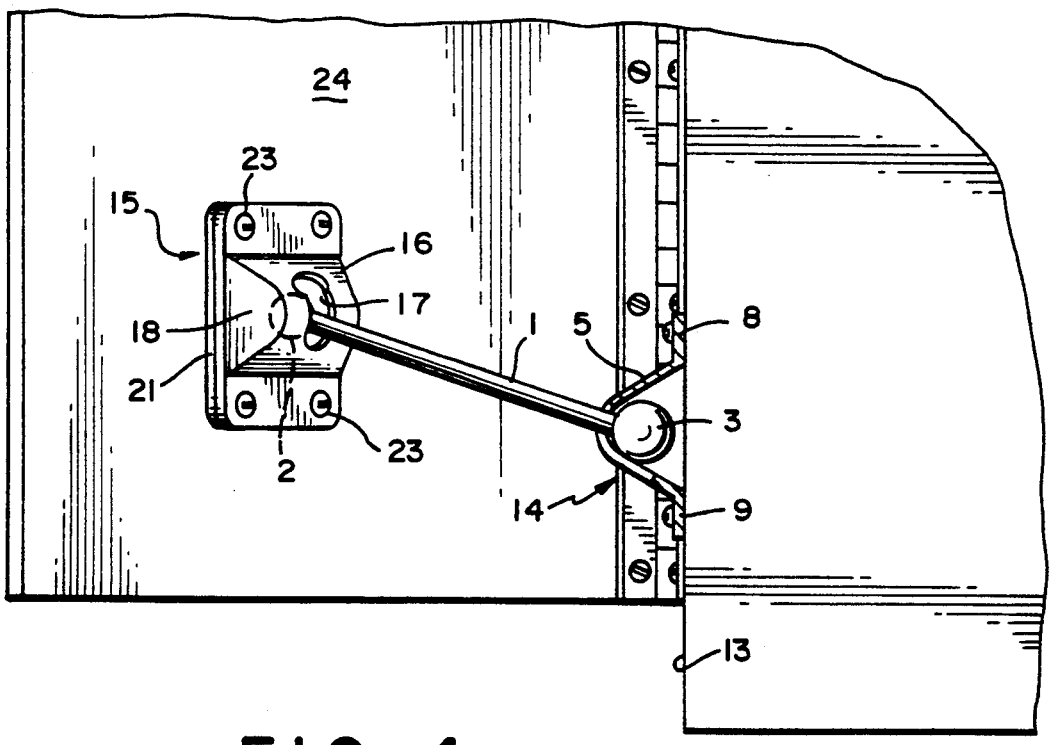
FIG. 4 is a fragmentary, side elevational view, partly in section, of the door hold back in the operative position holding a door in the open position wherein the components of the hold back are non-aligned.

The receiver assembly 15 is then secured to the cargo door 24 as shown in FIG. 2 so that the base plate assembly 14 and receiver assembly 15 are substantially aligned, whereby the spherical end portion 2 of the link can be inserted into the receiver key hole slot 17 to hold the door 24 in the open position as shown in FIGS. 3 and 4. To release the door 24, the spherical end 2 of the link is pulled out of the key hole slot 17, and the link 1 is allowed to fall and depend from the base plate assembly 14 as shown in FIG. 2. The link 1 is adapted to hang at approximately 15° from the vehicle wall 13 to prevent the vehicle wall from becoming defaced.

As will be seen in FIGS. 3 and 4, the construction and arrangement of the base plate assembly 14, receiver assembly 15 and link 1 having spherical end portions 2 and 3 are such that a misalignment in the order of 15° between the base plate and receiver assemblies can be allowed while still maintaining the hold down fully functional.

Large clearances are provided within the sockets of the base plate 14 and receiver 15 between the walls of the sockets and their respective spherical portions 2 and 3 of the link 1 to prevent the link 1 from becoming locked within the sockets due to the accumulation of dirt and/or ice on the base plate 14 and receiver 15.

To prevent the spherical end 2 of the link 1 from coming out of the socket and key hole slot of the receiver 15 during the compression of the link 1, the inclined surface 22 of the back-up plate 21 is provided to deflect the spherical portion 2 when link 1 is compressed, to the bottom of key hole slot 17.

The components of the link 1, mounting plate 14 and receiver 15 are all of molded high impact polypropylene plastic to thereby overcome the problems of rust, and the possible scratching or defacing of the vehicle door and wall surfaces during manipulation of the link 1 during the connection and disconnection thereof with the receiver 15.

The link 1 can also be molded to various lengths for accommodation to wider installation ranges between the vehicle wall surface 13 and cargo door 24.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A door hold back for holding the cargo door of a vehicle in the open position while the vehicle is being loaded and unloaded comprising a link having integral spherical portions on each end, means for connecting one spherical end portion of the link to a wall surface of the vehicle which comprises a base plate having an arcuate wall and side walls forming a socket, a key hole slot formed in said arcuate wall, said one spherical end portion of said link being positioned within said socket and being dimensioned to prevent removal therefrom through the key hole slot, the adjacent end portion of the link extending through said key hole slot, mounting flanges integral with said arcuate and side walls, and fastners extending through said flanges securing the base plate to the wall surface of the vehicle and means for releasably connecting the other spherical end portion of the link to the cargo door.

2. A door hold back for holding the cargo door of a vehicle in the open position while the vehicle is being loaded and unloaded comprising a link having integral spherical portions on each end thereof, means for connecting one spherical end portion of the link to a wall surface of the vehicle and means for releasably connecting the other spherical end portion of the link to the cargo door which comprises a receiver having a arcuate wall and side walls forming a socket, a key hole slot formed in said arcuate wall, the other spherical end portion of the link being dimensioned to be movable through said key hole slot, whereby said other spherical end portion of the link is releasably connected to the receiver.

3. A door hold back for holding the cargo door of a vehicle in the open position while the vehicle is being loaded and unloaded comprising, a link having integral spherical portions on each end thereof, a base plate having an arcuate wall and side walls forming a socket, a key hole slot formed in said arcuate wall, said one spherical end portion of said link being positioned within said socket and being dimensioned to prevent removal therefrom through the key hole slot, the adjacent end portion of the link extending through said key hole slot, mounting flanges integral with said arcuate and side walls, fasteners extending through said flanges securing the base plate to the wall surface of the vehicle; a receiver secured to the cargo door substantially in alignment with said base plate, said receiver having an arcuate wall and side walls forming a socket, a key hole slot formed in said arcuate wall, the other spherical end portion of the link being removably mounted in the receiver socket and being dimensioned to be movable through the receiver key hole slot for connecting and disconnecting the link to the cargo door.

4. A door hold back according to claim 3, wherein the link when disconnected from the cargo door hangs from the base plate at approximately 15° from the vehicle wall to thereby prevent the vehicle wall from becoming defaced.

5. A door hold back according to claim 3, wherein the base plate and receiver are mounted in misalignment in the order of 15°.

6. A door hold back according to claim 3, wherein large clearances are provided within the sockets of the base plate and receiver between the spherical portions and their respective socket walls, to thereby prevent the link from becoming locked within the sockets due to the accumulation of dirt and/or ice on the base plate and receiver.

7. A door hold back according to claim 3, wherein the receiver includes a back-up plate having an inclined surface engageable by the other spherical end portion of the link to prevent said other spherical end portion of the link from coming out of the receiver socket and key hole slot during compression of the link.

8. A door hold back according to claim 3, wherein the link and associated spherical end portions, mounting plate and receiver are all of molded high impact polypropylene plastic to thereby overcome the problems of rust and defacing of the vehicle door and wall surfaces.

* * * * *